US005791970A

United States Patent [19]

Yueh

[11] Patent Number: 5,791,970

[45] Date of Patent: Aug. 11, 1998

[54] SLURRY RECYCLING SYSTEM FOR CHEMICAL-MECHANICAL POLISHING APPARATUS

[76] Inventor: William Yueh, P.O. Box 5874, Fullerton, Calif. 92838

[21] Appl. No.: 833,444

[22] Filed: Apr. 7, 1997

[51] Int. Cl.[6] ..... B24B 57/00

[52] U.S. Cl. ..... 451/8; 451/5; 451/60; 451/446

[58] Field of Search ..... 451/8, 5, 446, 451/41, 60, 288, 287, 285, 290

[56] References Cited

U.S. PATENT DOCUMENTS

| | | | |
|---|---|---|---|
| 3,028,711 | 4/1962 | Campbell et al. | 451/446 |
| 3,162,986 | 12/1964 | Olivieri | 451/446 |
| 3,500,591 | 3/1970 | Gawronski et al. | 451/60 |
| 4,059,929 | 11/1977 | Bishop | 451/60 |
| 5,658,185 | 8/1997 | Morgan, III et al. | 451/36 |
| 5,664,990 | 9/1997 | Adams et al. | 451/60 |

*Primary Examiner*—Robert A. Rose
*Attorney, Agent, or Firm*—Herbert M. Shapiro

[57] ABSTRACT

A slurry recycling system for a chemical-mechanical polishing apparatus includes an annular-shaped wafer polishing platen which rotates about a non-rotating center core. A slurry dispensing system housed in the center core directs a slurry mist radially into the path of a moving wafer. The recycling system is positioned at the periphery of the platen and is controlled by an end point monitoring and control system which uniquely provides instantaneous wafer removal rate data to regulate a slurry recycling valve.

8 Claims, 3 Drawing Sheets

SLURRY RECYCLING SYSTEM FOR CHEMICAL-MECHANICAL POLISHING APPARATUS

FIELD OF THE INVENTION

This invention relates to semiconductor wafer, oxide or metal layer polishing apparatus and more particularly to such apparatus which includes a rotating platen against which wafers are positioned for chemical-mechanical polishing.

BACKGROUND OF THE INVENTION

Chemical-mechanical polishing (CMP) techniques for obtaining planar surfaces for semiconductor wafers are well known. Such techniques commonly employ a polishing pad mounted on a circular polishing wheel. A wafer is mounted on a wafer carrier and juxtaposed against the pad in the presence of a slurry much in the manner familiar in the polishing of optical lenses. Typically, both the wafer and the pad rotate about respective axes. The wafer, further, is moved about the pad surface, the pad being much larger than the wafer. Thus, a wafer rotates against the pad which itself is moving. Whether the polishing pad actually contacts the wafer surface or exerts pressure on the slurry to remove material from the wafer surface, the slurry has been found to be required for optimum results to be obtained.

Alternative planarization techniques are also in use. Such techniques are referred to as "dry" techniques and include ion and plazma etching. The dry techniques had gained popularity as the techniques of choice in wafer polishing. But, as wafer diameter increased and as smaller and smaller wafer surface feature sizes were demanded, CMP "wet" processing has been found to be the only technique that can meet the demanding requirements for both global surface uniformity and local planarity.

But, there were problems associated with CMP processing that were compounded by the small (submicron) dimensions required in the small devices that were becoming available. The problems related to uniformity and control of the polishing process itself. For example, multi-level metalization required each semiconductor layer to be uniform so that metal deposition on inter-level dielectric could be controlled properly. Consequently, higher tolerances were needed for the polishing process to avoid uneven layer thickness or layer penetration. Layer thickness had to be more uniform and irregularities on a wafer surface had to be reduced to more acceptable levels in order to achieve an acceptable level of uniformity for each deposited layer on the wafers.

Efforts have been made to achieve greater uniformity and to reduce surface irregularities. U.S. Pat. No. 5,562,530 issued Oct. 8, 1996, for example, describes a technique for pulsing the wafer carrier to vary the distance between the pad and the wafer surface and thus to vary the downward force on the wafer. This action allows the slurry to provide better lubrication of the wafer when the force is at a minimum. It is argued that the pulsed technique allows for a substantially continuous and controllable process for polishing semiconductor wafers.

But, the problem still remains with respect to slurry uniformity, the out of plane positioning of the wafer itself, the need to remove the wafer from the apparatus for testing, and the inability of determining easily when the desired surface characteristics have actually been achieved, all of which problems effect layer uniformity and the level of surface irregularities.

Copending application Ser. No. 08/806769 filed Feb. 14, 1997 for the applicant herein discloses an in-situ end point determination apparatus and method for a CMP process. The apparatus disclosed therein employs a Kalman filter for determining the instantaneous wafer removal rate and thickness information which is not provided by prior art end point determining apparatus. The disclosed technology uniquely determines the wafer removal rate. Copending application Ser. No. 08/789840 filed Jan. 24, 1997, also for the applicant herein, discloses a wafer polishing apparatus with a non rotating center core with an annular platen which rotates about that core. A slurry dispensing system is located in the center core. The present invention takes advantage of the unique availability of instantaneous wafer thickness and removal rate data to control a slurry collection and recycling system and is described in the context of the apparatus with the non rotating center core, but can be seen to be useful with CMP apparatus with a rotating circular platen or linearly moving platen.

BRIEF DESCRIPTION OF THE INVENTION

In accordance with the principles of this invention, a slurry collection funnel is positioned underneath the rotating platen such that the periphery of the platen fits within the confines of the funnel. Thus, any slurry on the platen is captured by the funnel as it drips from the edge of the platen. The slurry moves from the funnel into a recycling conduit at a rate controlled by a valve in the conduit. The position of the valve, in turn, is controlled by the end point monitoring and control system noted above. Thus, the position of the valve is determined by the instantaneous wafer removal rate uniquely provided by the above mentioned end point determining system.

The slurry is filtered, agitated, the particle concentration is monitored, colloidal silica oxide or alumina particles are added, and the mix is brought to a desired concentration by adding deionized water. A control switch is provided to regulate the use of fresh slurry or recycled slurry for return to the slurry dispensing system.

BREIF DESCRIPTION OF THE DRAWINGS

DETAILED DESCRIPTION OF AN ILLUSTRATIVE EMBODIMENT OF THIS INVENTION

Figure 1:
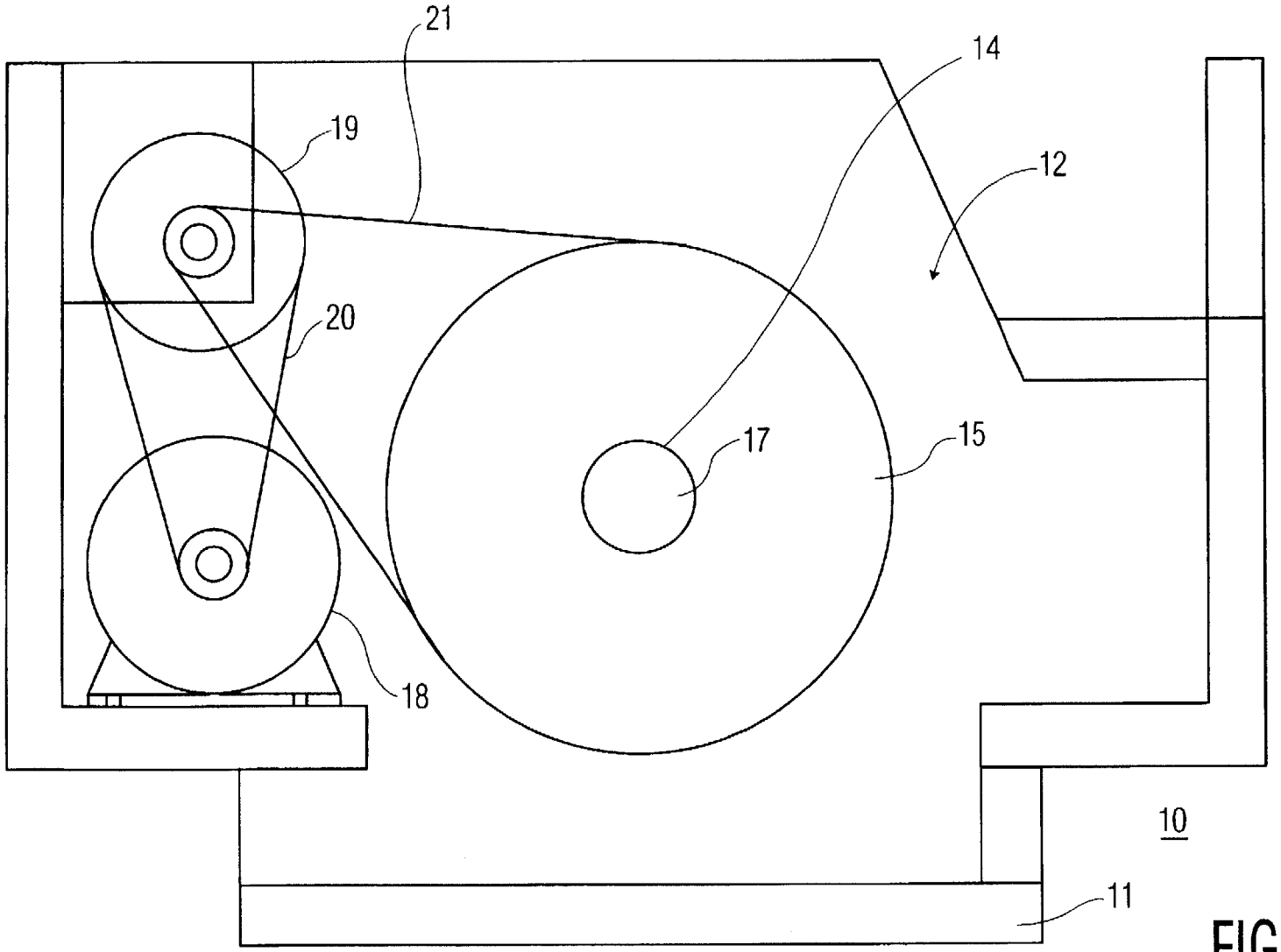
FIG. 1 is a top view of a CMP apparatus in accordance with the principles of this invention.

FIG. 1 shows a top view of a CMP wafer polishing apparatus 10. The apparatus comprises a rigid frame 11 and a top planar surface 12. The apparatus includes a center core 14, which is non rotating, and a rotating, annulus-shaped platen 15 which rotates in the plane of surface 12. The center core houses a slurry dispensing system which includes a slurry reservoir (not shown) with conduits to slurry dispensing slot(s) 17. The slurry is dispensed into the path of an oncoming pad onto the polishing area 16 as is fully described in the above-noted application Ser. No. 08/789840 for the dual head case.

The annulus-shaped platen is rotated by an edge drive arrangement comprising a motor 18 which drives pulley 19 by belt 20 and by belt 21, driven by pulley 19, and which engages the edge of the platen. The position of a wafer juxtaposed with platen 15 is indicated by circle 22 in FIG. 2.

Figure 2:
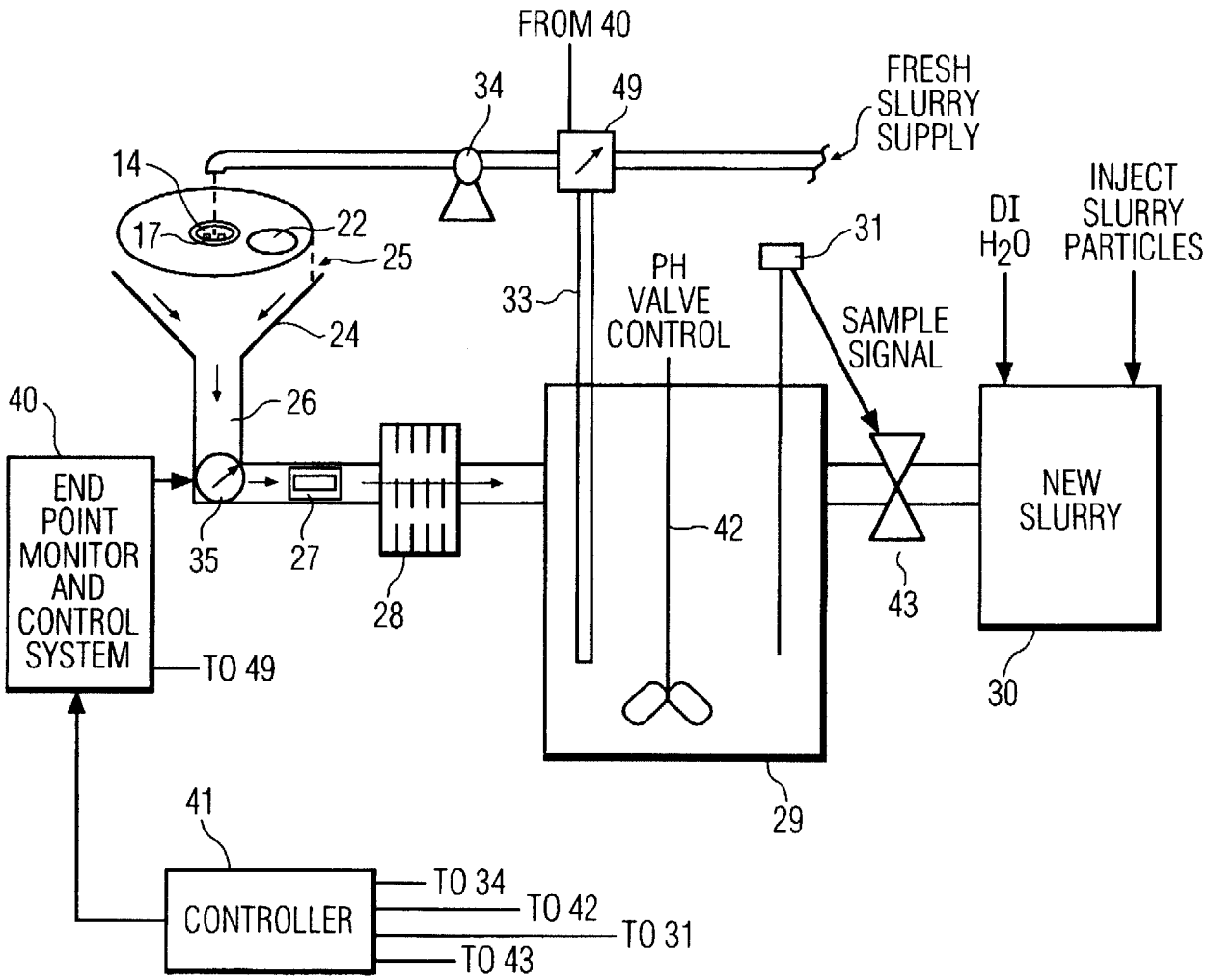
FIG. 2 is a schematic diagram of a slurry recycling system in accordance with the principles of this invention.

FIG. 2 shows a funnel 24 encompassing platen 15 positioned to capture slurry dripping from the edge of the platen as indicated at 25. The slurry, thus captured, is contained in tube 26 (with imbedded cartridge filters 27 in series) and moved through transverse filters indicated by block 28 into recycle tank 29. The recycled slurry is mixed with newly prepared slurry comprising injected slurry particles diluted with deionized water and contained in tank 30. The diluted mix is added to tank 29 under the control of particle size distribution sensor 31. The now reconstituted slurry is PH controlled, agitated, and recycled to the slurry dispensing system in center core 14 via conduit 33 under the control of pump 34.

Conduit 24 includes a valve 35 which controls the passage of used slurry to the recycle tank (29). The valve, in turn, is controlled by end point monitoring system disclosed in the above noted copending application Ser. No. 08/800769. The valve thus passes an amount of used slurry as a function of the instantaneous wafer removal rate. That is to say, when the removal rate is high, a greater amount of particulate matter is present in the slurry and more slurry is disposed of with less slurry being passed by the valve. In the absence of instantaneous wafer removal rate data, the valve timer setting would not faithfully follow the instantaneous rate at which material is removed from the wafer and the slurry would not be properly reconstituted for recycling. No prior art end point monitoring system is capable of supplying instantaneous wafer removal rate data with high accuracy. They all measure wafer thickness periodically and thus do not recommend themselves as slurry recycling control means. The end point monitoring system is indicated by block 40. The system is under the control of a controller 41 which may comprise any microprocessor capable of operating as described. The controller also controls the stir mechanism 42 and a valve 43 responsive to particle size sensor 31 for admitting newly prepared slurry to tank 29 to achieve the desired particle size distribution.

The return conduit 33 also includes a valve 49 which controls the passage of recycled or fresh slurry to be used in the CMP wafer processing. The valve is controlled also by the end point monitoring system (40) that provides instantaneous wafer thickness information with high precision, in addition to the wafer removal rate data, used in controlling valve 35.

Recycled slurry can be used during the initial polishing for removal of 80% to 90% of the deposited layer to achieve cost reduction. To control the defect density on polished wafers, valve 49 can be set to allow only fresh slurry to be pumped through to complete the removal of the remaining 10% to 20% of the layers. High precision control with the end point monitoring system disclosed in the above noted patent application Ser. No. 08/800769 is critical in achieving the desired savings without compromise in performance.

The filters indicated by block 28 preferrably comprises two coarse filters followed by onr medium membrane and one fine membrane.

Figure 3:
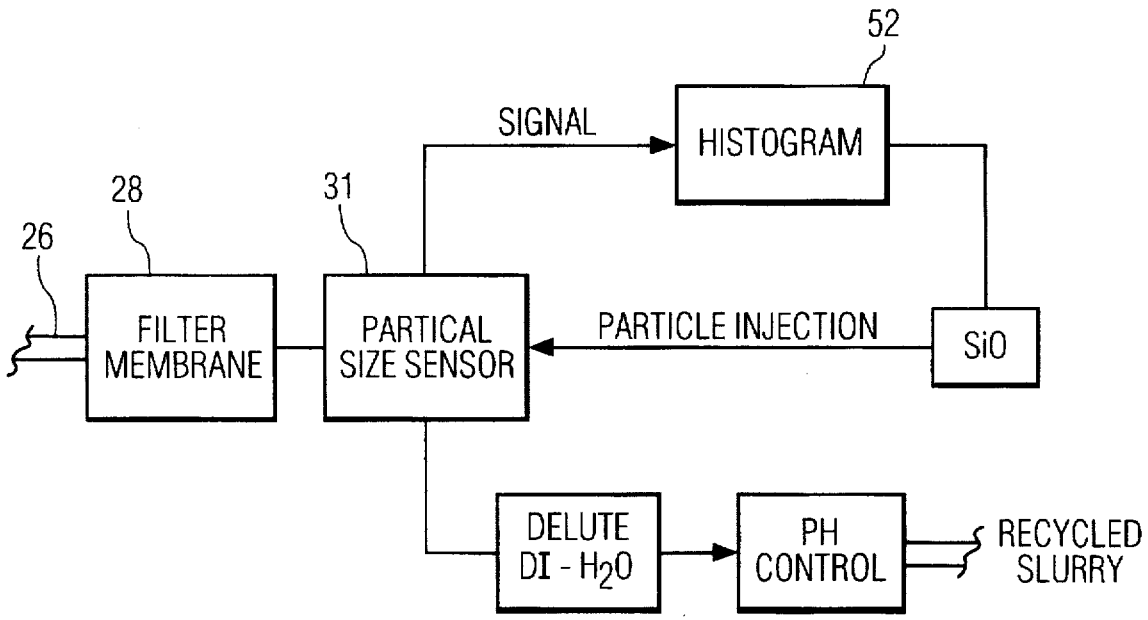
FIG. 3 is a block diagram for determining a histogram of the slurry particle size distribution.

FIG. 3 shows a block diagram of a particle size sensor operative to generate a histogram of the particles in the used slurry. The particle sensor is located after block 28 of FIG. 2 and is used to ensure that the amount of colloidal silica oxide particles introduced into tank 29 properly brings the mix in the tank into the desired log normal distribution characteristic of new slurry. The sensor employs the Capillary Hydrodynamic Fractionation (CHDF) methodology developed by Matec Applied Sciences, Hopkinton Mass., to characterize the particle size distribution of CMP polishing slurry. These polishing slurries typically exhibit log normal type PSD curves. The particle size ranges from about 20 nm to between 400 nm and 600 nm depending on particle batch. The maximum in the PSD curve is found at approximately 160 nm.

Figure 4:
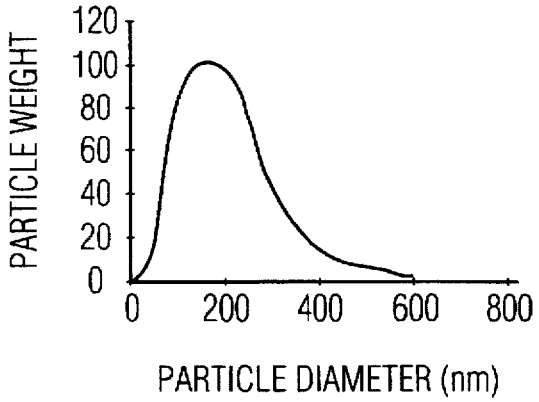
FIG. 4 is a plot of the particle size distribution over time.

The (particle size) sensor is represented by block 31 in FIG. 3 and is operative to produce a signal which generates the histogram shown in FIG. 4. The histogram also is represented by block 52 in FIG. 3. The histogram is constantly compared to the desired log normal distribution to control the contents of tank 30 of FIG. 2.

What is claimed is:

1. A slurry recycling system for chemical-mechanical polishing apparatus, said system including a platen rotatable about a center axis and having a periphery, said system including a slurry collection funnel positioned at said periphery, said system also including a means for dispensing slurry into the path of a wafer moving along said platen, a slurry conduit connecting said funnel and said means for dispensing slurry for recycling slurry from said funnel to said means for dispensing, said system including end point monitoring and control means for monitoring wafer removal rates, said slurry recycling system including a slurry control means in said conduit, said slurry control means being responsive to said end point control means for ensuring that the rate at which slurry is recycled corresponds to the instantaneous wafer removal rate.

2. A slurry recycling system as in claim 1 wherein said platen has the shape of an annulus and rotates about a non rotating center core, said center core including said means for dispensing slurry in the path of a wafer juxtaposed with said platen.

3. A slurry recycling system as in claim 1 wherein said slurry control means comprises a valve.

4. A slurry recycling system as in claim 2 wherein said slurry control means comprises a valve.

5. A slurry recycling system as in claim 1 also including a second slurry control means also under the control of said end point monitoring and control means for passing recycled or fresh slurry to said means for dispensing slurry.

6. A slurry recycling system as in claim 2 including a second slurry control means also under the control of said end point monitoring and control means for passing recycled or fresh slurry to said means for dispensing slurry.

7. A slurry recycling system as in claim 5 wherein said second slurry control means comprises a valve.

8. A slurry recycling system as in claim 5 wherein said second slurry control means comprises a valve.

* * * * *